US005462513A

United States Patent [19]

McAlister

[11] Patent Number: 5,462,513

[45] Date of Patent: Oct. 31, 1995

[54] CONTINUOUS DISCHARGE CENTRIFUGE

[76] Inventor: Steven A. McAlister, 9807 - 196 A Street, Langley, British Columbia, Canada, V3A 4P8

[21] Appl. No.: 256,501

[22] PCT Filed: Jan. 13, 1993

[86] PCT No.: PCT/CA93/00009

§ 371 Date: Jul. 13, 1994

§ 102(e) Date: Jul. 13, 1994

[87] PCT Pub. No.: WO93/13864

PCT Pub. Date: Jul. 22, 1993

[30] Foreign Application Priority Data

Jan. 13, 1992 [CA] Canada ..... 2059208-7

[51] Int. Cl.[6] ..... B04B 1/16

[52] U.S. Cl. ..... 494/56; 494/60; 494/83

[58] Field of Search ..... 494/43, 3, 11, 494/42, 56, 57, 58, 59, 60, 83; 210/781, 782

[56] References Cited

U.S. PATENT DOCUMENTS

| | | | |
|---|---|---|---|
| 1,882,389 | 10/1932 | MacIsaac . | |
| 3,047,214 | 7/1962 | Downing | 494/56 |
| 3,797,736 | 3/1974 | Gunnewig | 233/20 R |
| 3,823,809 | 7/1974 | Henry et al. . | |
| 3,823,869 | 7/1974 | Loison . | |
| 4,432,748 | 2/1984 | Novoselac et al. | 494/2 |
| 4,543,083 | 9/1985 | Bounds | 494/56 |
| 4,645,485 | 2/1987 | Niemerg | 494/56 |
| 4,824,431 | 4/1989 | McAlister | 494/43 |
| 5,203,999 | 4/1993 | Hugues | 494/60 |

FOREIGN PATENT DOCUMENTS

| | | | |
|---|---|---|---|
| 27536/88 | 6/1989 | Australia . | |
| 2180589 | 11/1973 | France | B04B 1/00 |
| 2307583 | 11/1976 | France | B04B 1/14 |
| 1632324 | 10/1970 | Germany | B04B 1/10 |

OTHER PUBLICATIONS

Andrew W. Jenike, "Storage and Flow of Solids", Nov. 1964, Bulletin of the University of Utah, Bulletin No. 123 of the Utah Engineering Experiment Station, pp. 10 to 12; 49 to 52; 68 to 81.

*Primary Examiner*—Robert W. Jenkins

*Attorney, Agent, or Firm*—Oyen Wiggs Green & Mutala

[57] ABSTRACT

Prior centrifugal concentrators for separating higher density particles from a slurry have not combined effective separation of concentrate with continuous discharge of the concentrate. The present invention provides a continuous discharge centrifugal concentrator having a retention zone for accumulating the concentrate in which a plurality of mass-flow hoppers are provided at the retention zone, with flow control devices to control the discharge of concentrate from the hoppers.

13 Claims, 10 Drawing Sheets

CONTINUOUS DISCHARGE CENTRIFUGE

The present invention relates to centrifugal concentrators of the rotating bowl type for the separation of solids of higher density such as gold, iron or tin from a slurry containing solids of a lower density and liquid and more particularly to centrifugal concentrators in which the target concentrate is continuously discharged.

BACKGROUND OF THE INVENTION

The problem of separating particles of high density such as gold, iron or tin from tailings and other slurry streams has attracted a great many attempted solutions. The problem is that of separating small particles of higher density from a slurry containing water and particles of lower density. One approach has been to use the centrifugal force created in a rotating bowl to separate the high density particles from the lower density slurry. In the past this had been generally done by placing obstructions such as ribs in the path of the rotating slurry to trap the heavier particles. This method had two problems. Where the slurry contained fine, dense particles such as magnetite, the grooves or depressions designed to retain the concentrate would rapidly pack with the unwanted fine particles. Secondly, this was a batch process in that it was necessary to periodically stop the centrifuge to empty it of the concentrate which had been collected.

The problem of packing has been largely solved by the present inventor's batch centrifugal concentrator which is the subject of U.S. Pat. No. 4,824,431. In that centrifugal concentrator, there are no obstacles to the flow of the slurry in the rotating drum. The slurry is delivered to the vicinity of the bottom of the rotating drum and travels up the smooth interior surface of the drum. The interior surface has three continuous zones: an outwardly inclined migration zone, a generally vertical retention zone above the migration zone, and an inwardly-inclined lip zone above the retention zone. The respective lengths and inclinations of the zones are selected to produce flow conditions in which less dense particles are expelled from the drum while denser particles migrate to and are retained in the retention zone. The result is that an enriched layer of concentrate accumulates in the retention zone without the use of ridges or grooves which may become packed.

It remains that this inventor's above-described centrifugal concentrator is a batch device and it is necessary to periodically stop the machine to empty it. In some situations, this periodic stoppage can add to the cost of running the centrifuge. Furthermore, to permit a continuous stream of tailings to be centrifuged would require multiple batch machines and complicated logistics. Also the concentrate retention capacity of the batch type is quite limited. Where the retention zone is flushed frequently the grade of concentrate is low, since a large proportion of non-enriched material is obtained with each flushing of the zone.

Centrifugal concentrators are known for continuous separation of suspended solids from a liquid. U.S. Pat. No. 3,797,736 Gunnewig issued Mar. 19, 1974 discloses a nozzle centrifuge for separating very fine particles from a liquid, having a series of principal discharge nozzles for continuous discharge of concentrate which are dis-posed a shorter distance from the axis of rotation than the outer periphery of the separating chamber. Auxiliary discharge nozzles are provided at the outer periphery of the separating chamber which are valved to periodically open if additional concentrate requires discharge. U.S. Pat. No. 4,432,748 Novoselac et al. issued Feb. 21, 1984 discloses a centrifuge for continuously dewatering a slurry and discharging the solid concentrate. These devices are directed only at removing solids from a slurry, rather than separating solids of a higher specific gravity from those of a lower specific gravity in a slurry. The Novoselac device requires adjustment of the entire bowl configuration to adapt to small variations in the feed parameters and so would have difficulty in practice providing a constant stream of discharge.

There is therefore a need for a continuous discharge centrifugal concentrator which has the advantages of the present inventor's non-packing smooth-flowing batch centrifuge.

SUMMARY OF THE INVENTION

The present invention provides a continuous discharge centrifugal concentrator comprising a) a hollow drum having an inner surface, the inner surface comprising a zone adapted to retain material of higher density; b) means for rotatably supporting the drum on an axis; c) drive means for rotating the drum about the axis; d) material supply means for delivering a slurry into the drum; e) a plurality of cavities extending outwardly with respect to the axis of rotation of the hollow drum in the retention zone, located outwardly of the retention zone and with the inlets of the cavities communicating with the retention zone and the outlets of the cavities located outwardly from the inlets; and f) flow controlling means for controlling the flow of material from the outlets of the cavities.

BRIEF DESCRIPTION OF THE DRAWINGS

In drawings which illustrate a preferred embodiment of the invention.

Figure 20:
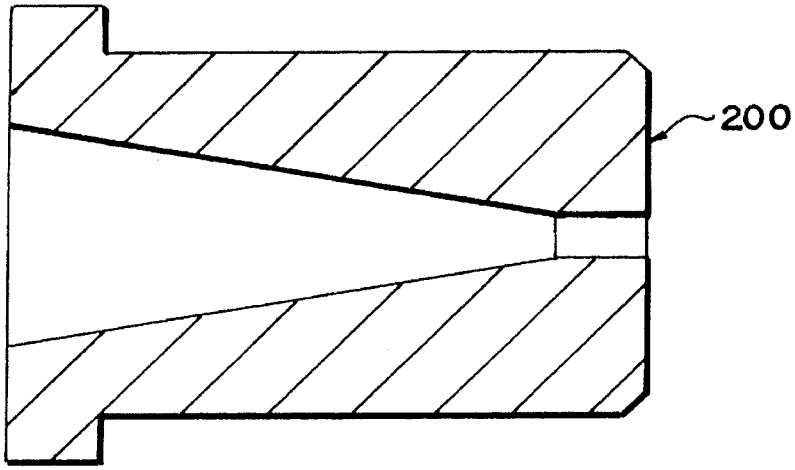
Figure 15:
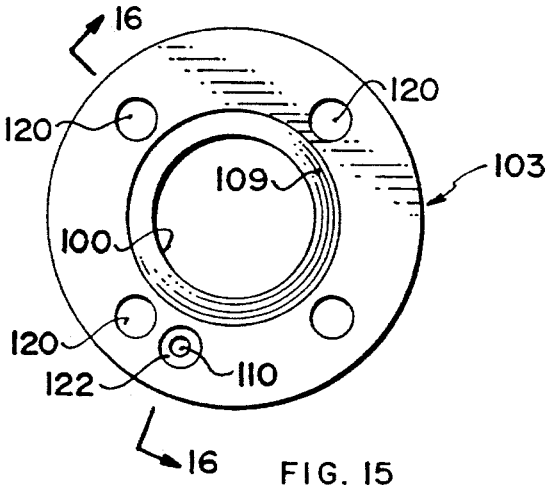
FIG. 15 is a front view of the outboard valve body.
Figure 16:
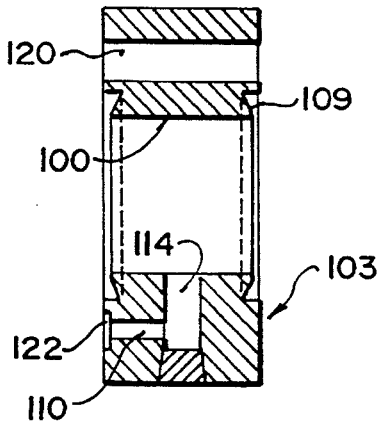
FIG. 16 is a cross-sectional view taken along lines XVI—
Figure 17:
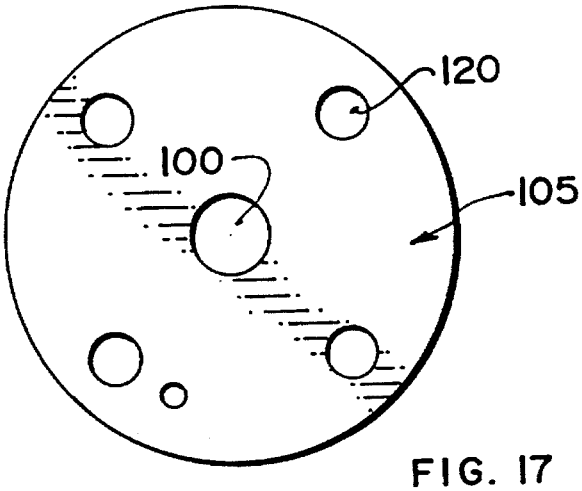
Figure 18:
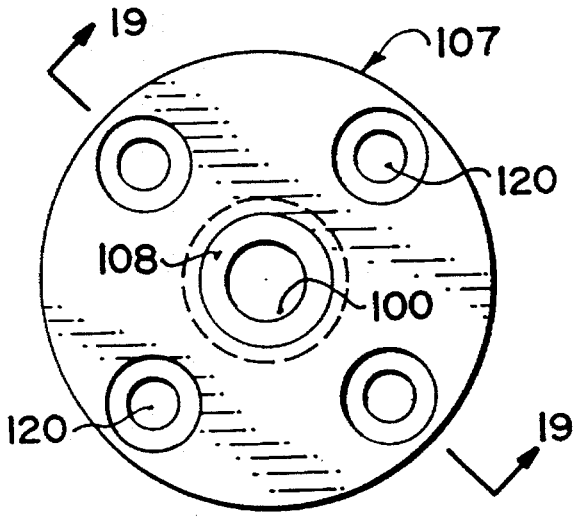
Figure 19:
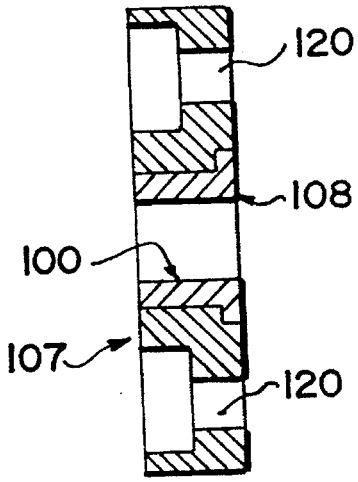

XVI of FIG. 15;

FIG. 17 is a front view of the valve spacer;

FIG. 18 is a front view of the valve end cap and ceramic wear nozzle;

FIG. 19 is a cross-sectional view taken along lines XIX—XIX of FIG. 18;

FIG. 20 is a cross-sectional view of a nozzle for use in the invention; and

Figure 21:
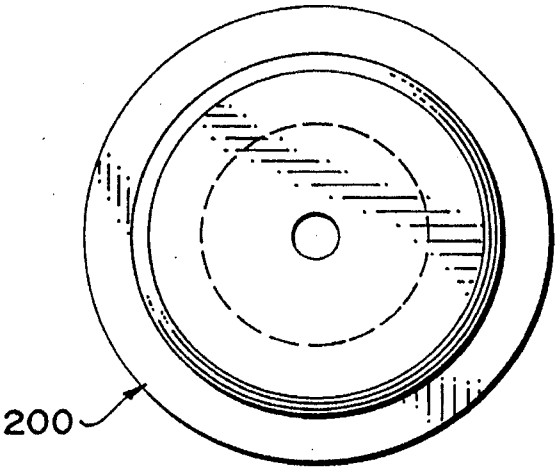

FIG. 21 is an end view of the nozzle as in FIG. 20.

DETAILED DESCRIPTION OF A PREFERRED EMBODIMENT

Figure 1:
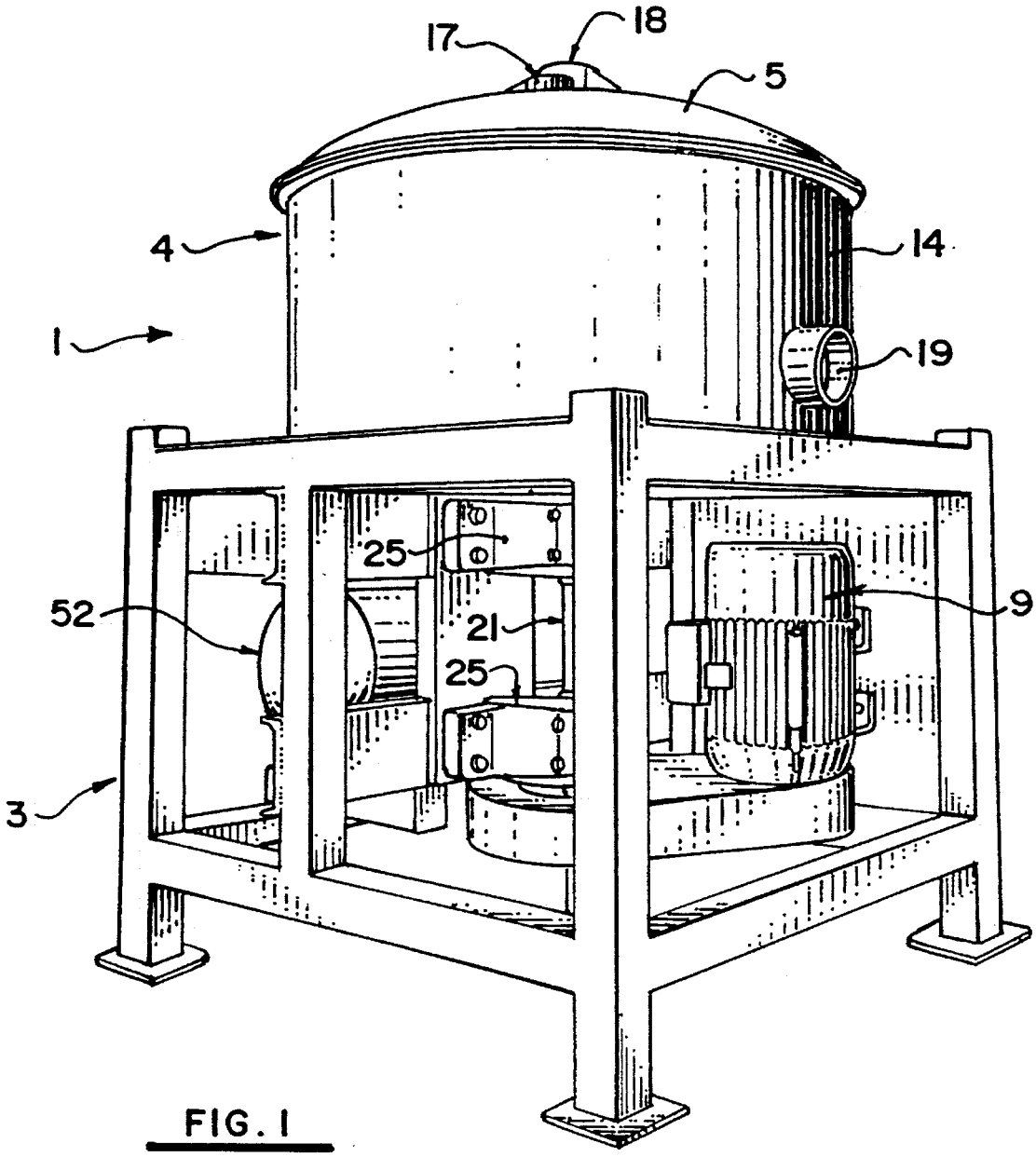
FIG. 1 is a perspective view of the centrifuge of the invention.
Figure 2:
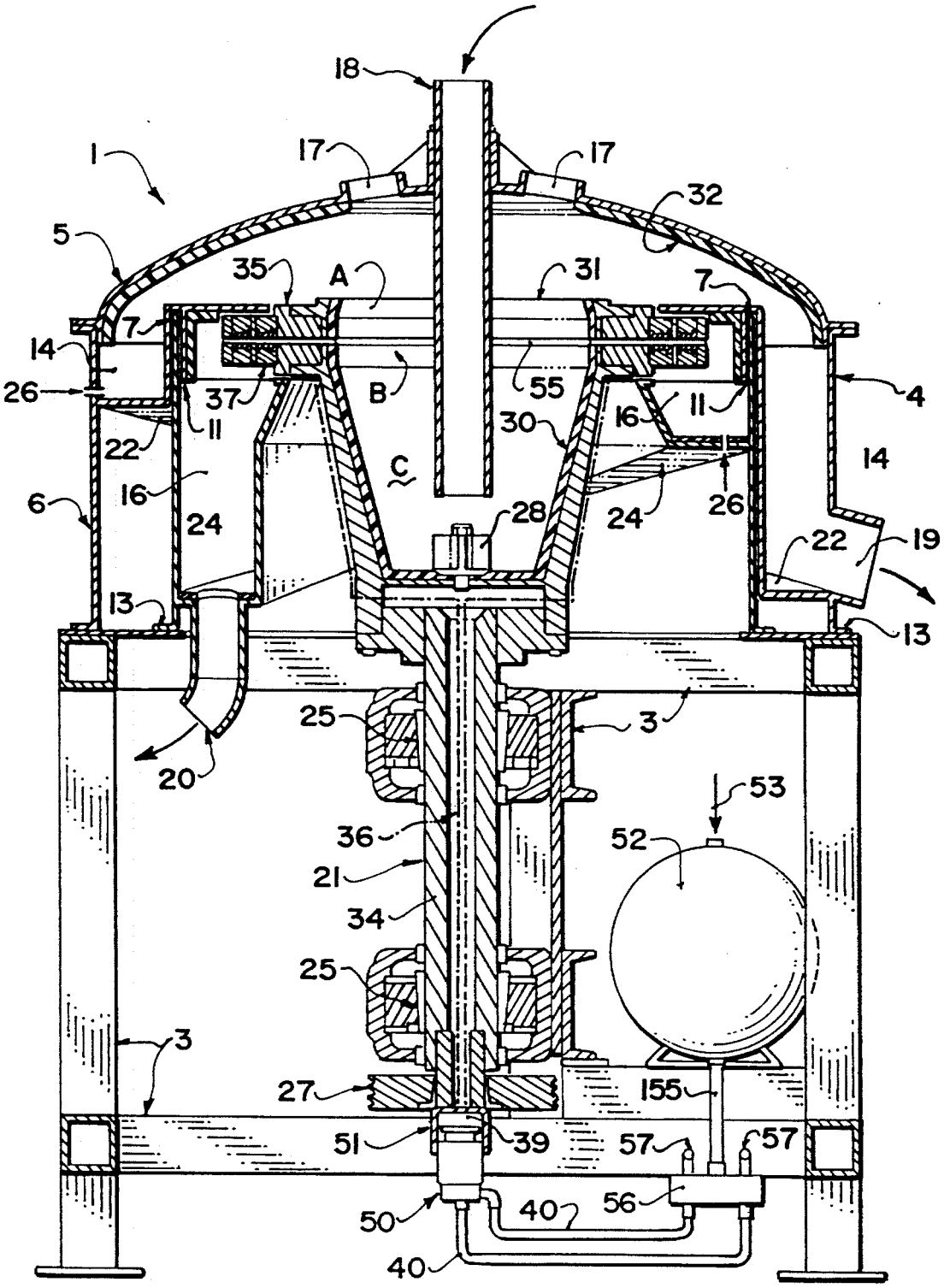
FIG. 2 is a vertical cross-section of the invention shown in FIG. 1.

With reference to FIGS. 1 and 2, the centrifuge of the invention is designated by reference numeral 1. It has a frame 3, a shroud 4 consisting of shroud lid 5 and tailings launder 14, and drive motor 9. The frame is constructed of hollow steel sections. The shroud lid 5 has openings for a slurry feed pipe 18 and inspection ports 17 and an inner lining 32 of a wear resistant material such as LINATEX™. The flange of shroud lid 5 is bolted to an upper flange of tailings launder 14. Tailings launder 14 is provided with a tailings discharge port 19. Nested in tailings launder 14 is a concentrate launder 16 with a concentrate discharge port 20 . The floors 22 and 24 respectively of launders 14 and 16 form helical spirals downwardly to assist in a smooth outward flow of the discharge and are preferably coated with an ultra-high molecular weight polyethylene. Water may be introduced at ports 26 to further assist the flow in the launder. The upper section of the tailings launder, where it forms the outer wall of the concentrate launder adjacent the output of flow control valves 37, is also provided with an inner lining 32 of a wear resistant material such as LINATEX™.

The upper outside edge 7 of concentrate launder 16 extends into a circular slot 11 formed on the inner wall of tailings launder 14, forming a labyrinth seal between the two launders. This construction permits the two launders to be rotated to locate the discharge ports at the desired locations before the two launders are bolted to the frame by flanges 13. It also permits each launder to be independently lifted out of the machine for ease of access and repair.

Rotor 21 is of the same general type disclosed in this inventor's U.S. Pat No. 4,824,431 in that, rather than relying on obstructions to the slurry flow in the surface of the rotor bowl, the inner surface of rotor bowl 23 forms three zones: a migration zone, a retention zone and a lip zone, which cause the denser target particles from the slurry flow to be concentrated in the retention zone in the manner described in U.S. Pat. No. 4,824,431. The rotor 21 is mounted in the frame 3 by bearing assemblies 25. The rotor has a sheave 27 which is driven by a belt (not shown) driven by electric motor 9. The rotor is provided with hopper rings 35 and flow control valves 37, which will be described in further detail below. An impeller 28 is provided on the centre of the floor of bowl 23 which has three or four upstanding vanes to assist in the rotation of the slurry.

With reference to FIG. 2, the rotor bowl 23 has an inner surface forming zones A, B and C corresponding to the migration zone, retention zone and lip zone as in the inventor's batch machine described in U.S. Pat. No. 4,824,431. Whereas the inventor's batch centrifuge has a solid wall for the entire interior surface of the rotor bowl, the present invention has a continuous ½-inch slot 55 formed in the surface of the retention zone B between the lower edge of the inner surface of lip 31 and the upper edge of the inner surface of lower bowl 30. Slot 55 opens to a series of mass-flow hoppers formed between two polyurethane hopper rings 60, 64 which hoppers in turn open to the flow control valves 37. For the present invention, an angle of 14 degrees from vertical is preferred for the slope of the migration zone where the target materials have high specific gravity, and the retention zone can be shorter than in the batch version.

Figure 3:
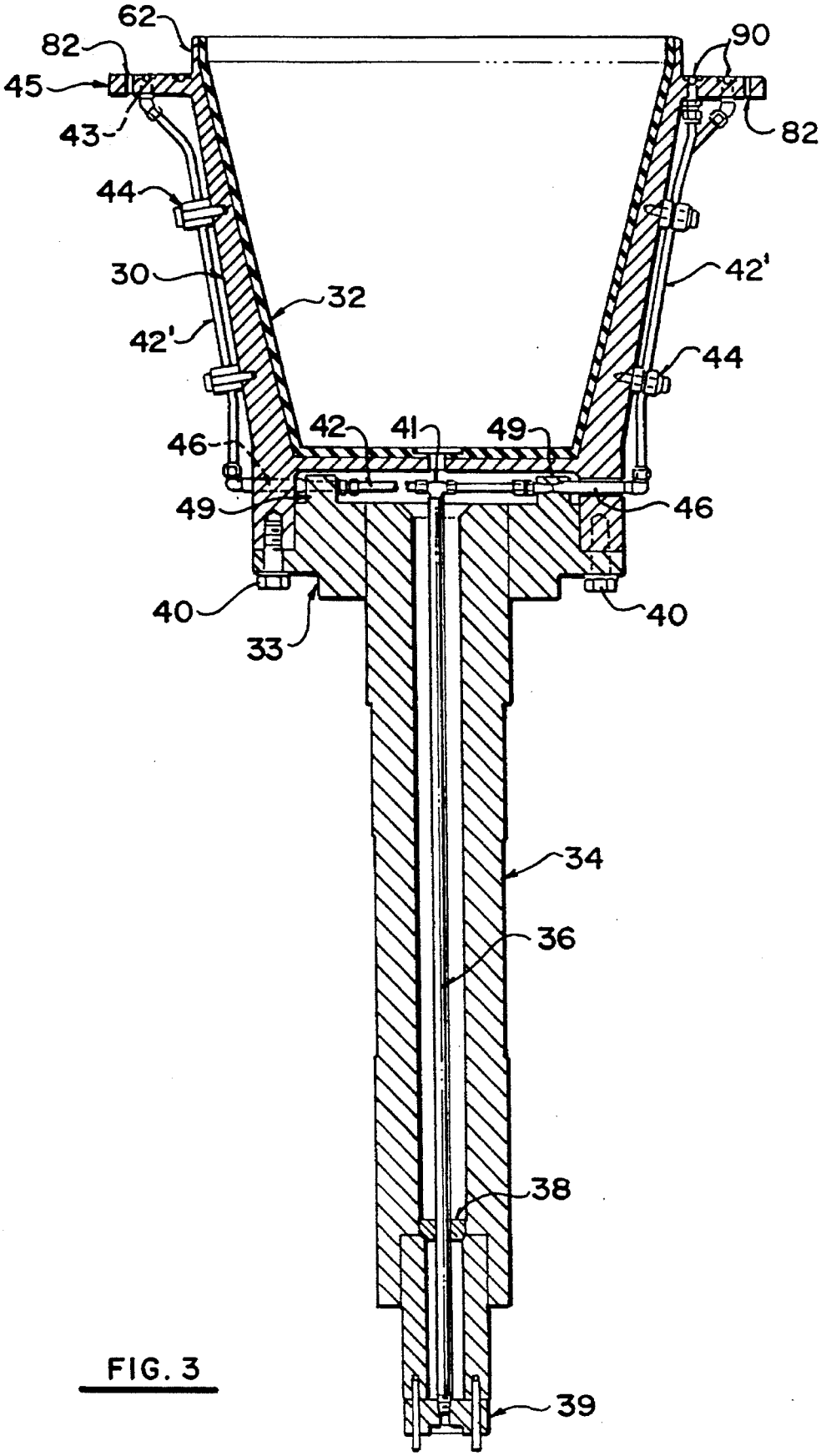
FIG. 3 is a vertical cross-sectional view of the lower rotor bowl and shaft assembly.
Figure 4:
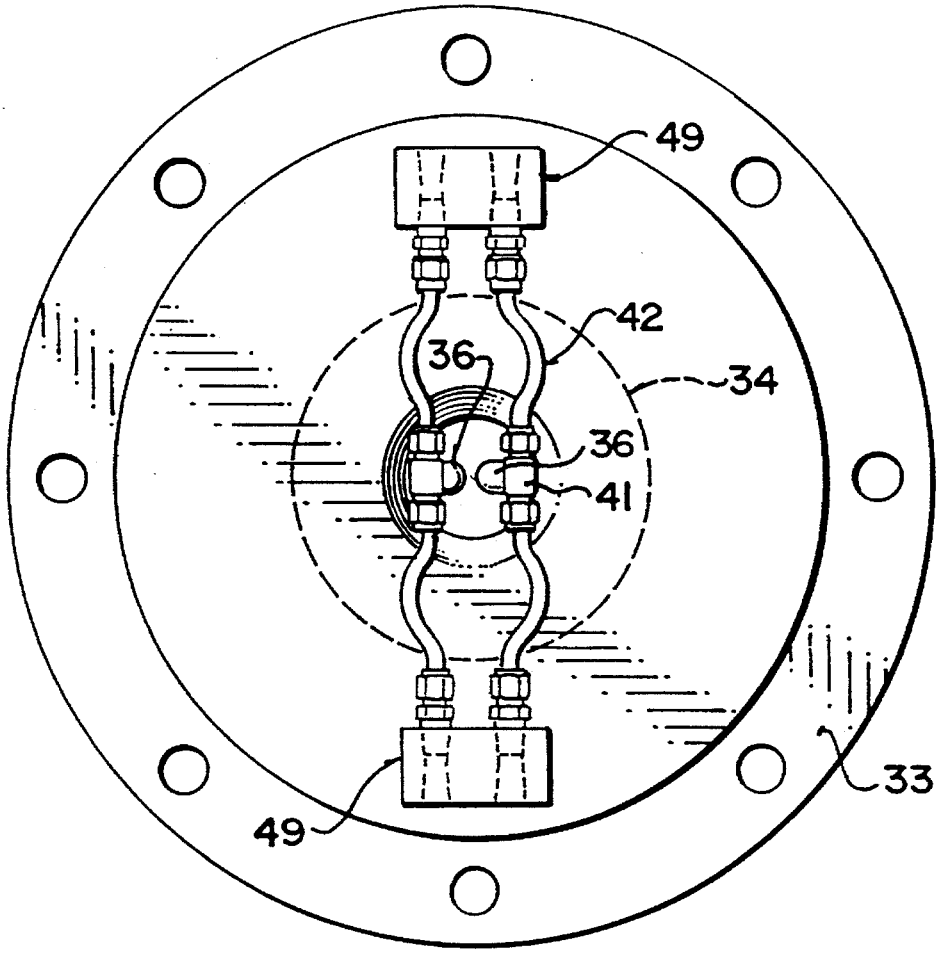
FIG. 4 is a plan view of the rotor shaft before assembly to the rotor bowl.
Figure 5:
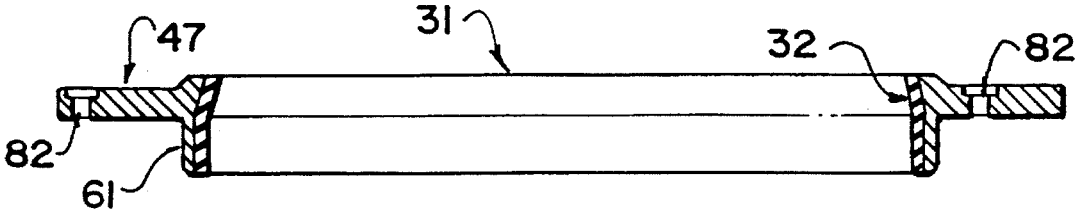
FIG. 5 is a vertical cross-sectional view of the bowl lip section.
Figure 10:
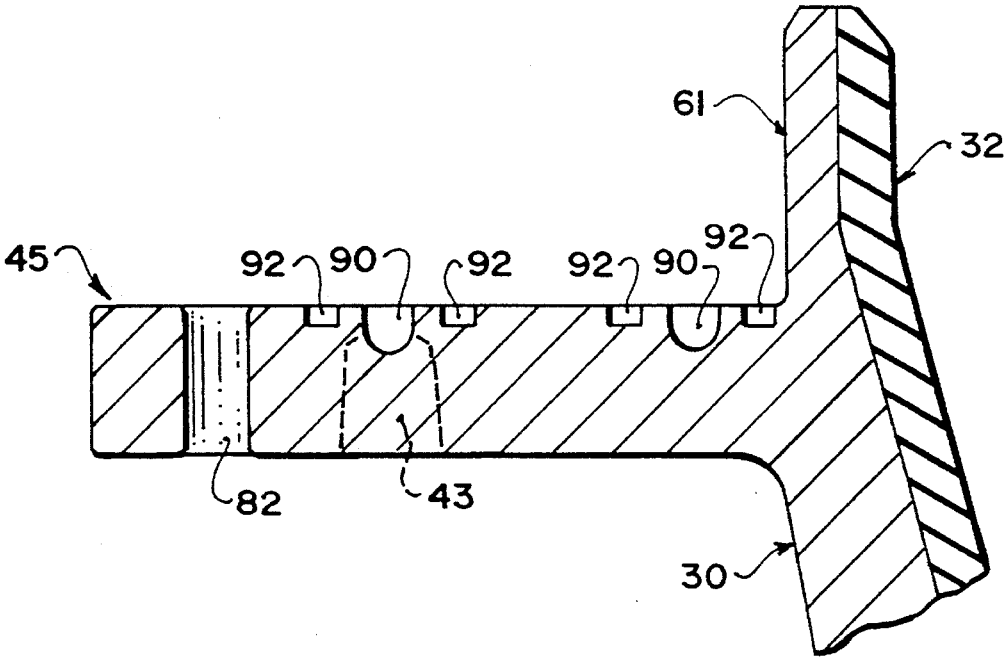
FIG. 10 is a vertical cross-sectional view of the lower bowl section flange.

Rotor bowl 23 is formed of a steel lower bowl section 30, shown in more detail in FIG. 3, and steel lip 31 shown in FIG. 5. The inner surface of both has a lining 32 of a wear resistant material such as a ¼-inch layer of LINATEX™. Bowl section 30 is bolted by bolts 40 to annular base 33 which in turn is fixed to hollow rotor shaft 34. Two air supply pipes 36 run up the centre of rotor shaft 34 and are secured by pipe brace 38. Pipes 36 connect the rotating union adapter 39 to two T-connections 41. Union adapter 39 connects the rotor shaft to rotating union 50. A cover 51 is provided to shield the union 50 and adapter 39. Four stainless steel tubes 42 carry the air from T-connections 41 to junction blocks 49 which are welded to rotor shaft 34. Short air supply pipes 46 extend through apertures in bowl 30 to connect the sections of tubes 42 entering junction blocks 49 to sections 42' of the air tubes which run to apertures 43 in flange 45, which in turn communicate with annular manifolds 90 (FIG. 10). Clamps 44 secure the tubing 42 to the bowl. This design allows the bowl 30 to be bolted to shaft 34 and the air lines to be secured subsequently.

The flow control valves 37 are operated by compressed air which is supplied to the rotor by rotating union 50. The purpose of the rotating union is to provide the compressed air from a storage tank 52 (to which pressurized air is periodically supplied through 53) via two stationary supply lines 40 to the two rotating supply lines 36 without loss of pressure. Compressed air runs from tank 52 via line 155 through a filter, regulator and lubricator assembly (not shown) to a solenoid valve 56. Valve 56 has two outlet lines 40 and two exhaust ports 57. It operates so that compressed air is provided alternately to the two outlet lines 40. When compressed air is not provided to a line 40, it is open to its exhaust port 57. An electronic control (not shown) allows the rate of alternately providing compressed air to the two lines 40 to be varied, and the exhaust ports 57 can be throttled for fine tuning.

Figure 11:
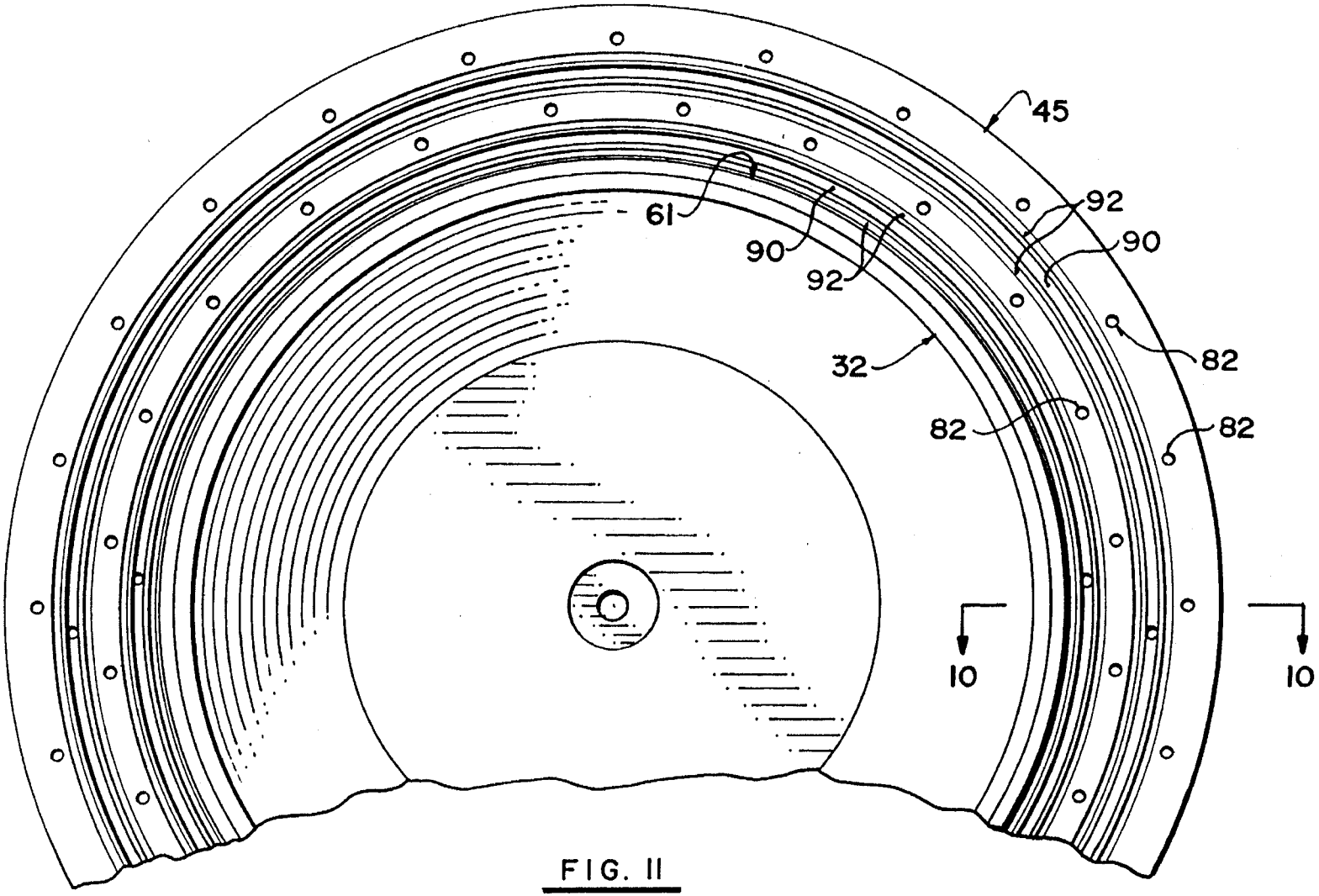
FIG. 11 is a top view of the lower bowl section.

Supply lines 36 in turn run up the centre of rotor shaft 34 to T-connections 41 where the air flows into separate supply lines 42. There are two separate air circuits, operating the inner and outer banks of flow control valves separately. Two lines 42' are provided for each circuit at diametrically opposed locations on the rotor bowl for purposes of dynamic and air flow balancing. In this way the two valves in a given flow control valve assembly 37 are equidistant from their respective air supplies. As shown in FIG. 10 and 11, supply tubing 42 supplies the pressurized air to manifolds 90, which are annular grooves cut in the upper surface of flange 45. Annular grooves 92 running parallel to manifolds 90 receive rubber O-rings, when the hopper rings are assembled, to seal the manifolds 90. When the hopper ring assembly 35 is bolted onto flange 45 through holes 82, holes 71 then communicate with manifolds 90 to supply air through passageways 67 to the flow control valves.

Figure 6:
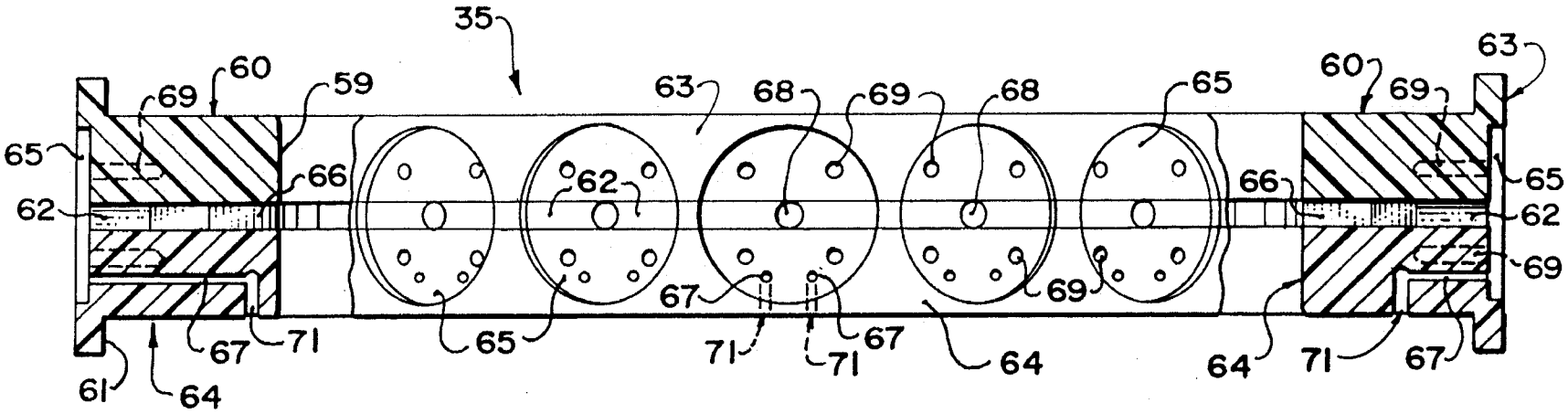
FIG. 6 is a view of the hopper ring assembly, partly in elevation and partly in cross-section taken along lines VI—VI of FIG. 7.
Figure 12:
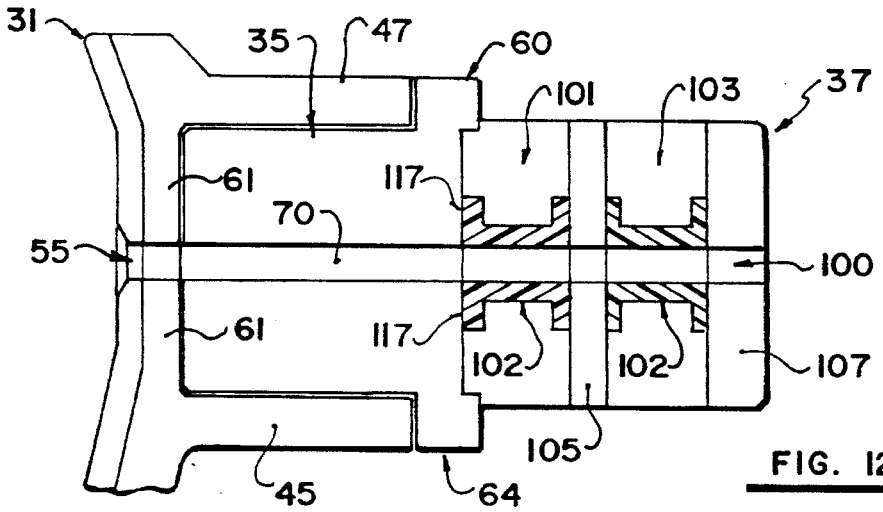
FIG. 12 is a cross-sectional view of a flow control valve and hopper assembly.
Figure 13:
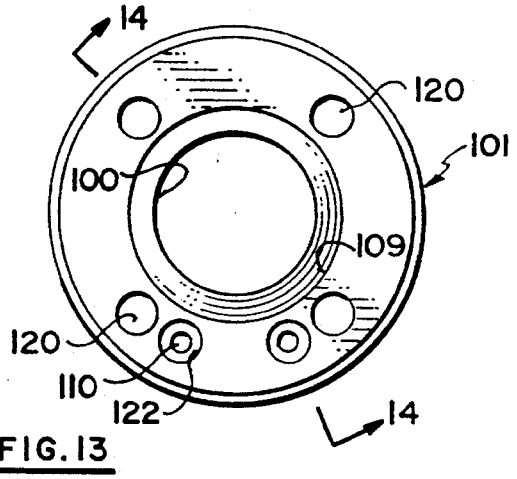
FIG. 13 is a front view of the inboard valve body.
Figure 14:
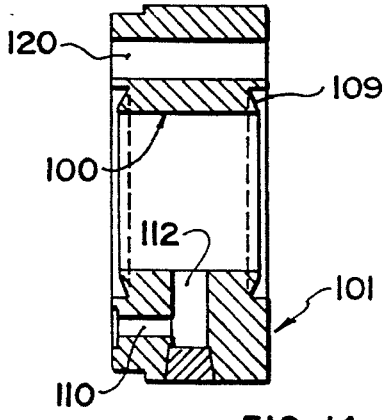
FIG. 14 is a cross-sectional view taken along lines XIV—XIV of FIG. 13.

Hopper rings 35 are shown in FIG. 6. They consist essentially of two annular rings—top ring 60 and bottom ring 64, as well as hopper halves 62 and hopper inserts 66 which are sandwiched between rings 60 and 64. The rings 60, 64, halves 62 and inserts 66 are all moulded or cast and then machined from a polyurethane plastic material such as REDCO 750™ or other wear-resistant material such as ALANX™. Rings 60 and 64 are identical in shape. The inner circumference 59 of the hopper ring assembly bears against surface 61 (FIG. 12) of the rotor bowl assembly 30 and 31. The outer face 63 of the ring assembly 35 has a series of disc-shaped depressions 65 spaced every 15 degrees around the circumference of the ring assembly which receive the twenty-four flow control valve assemblies 37. Circular outlet apertures 68 are provided every 15 degrees in the circumference of the hopper ring assembly 35 to communicate between flow control valves 37 and hoppers 70. Passageways 67 are drilled in lower ring 64 to supply air to flow control valves 37 from holes 71. Holes 69 are drilled to secure the flow control valves 37 by bolts or the like.

Figure 7:
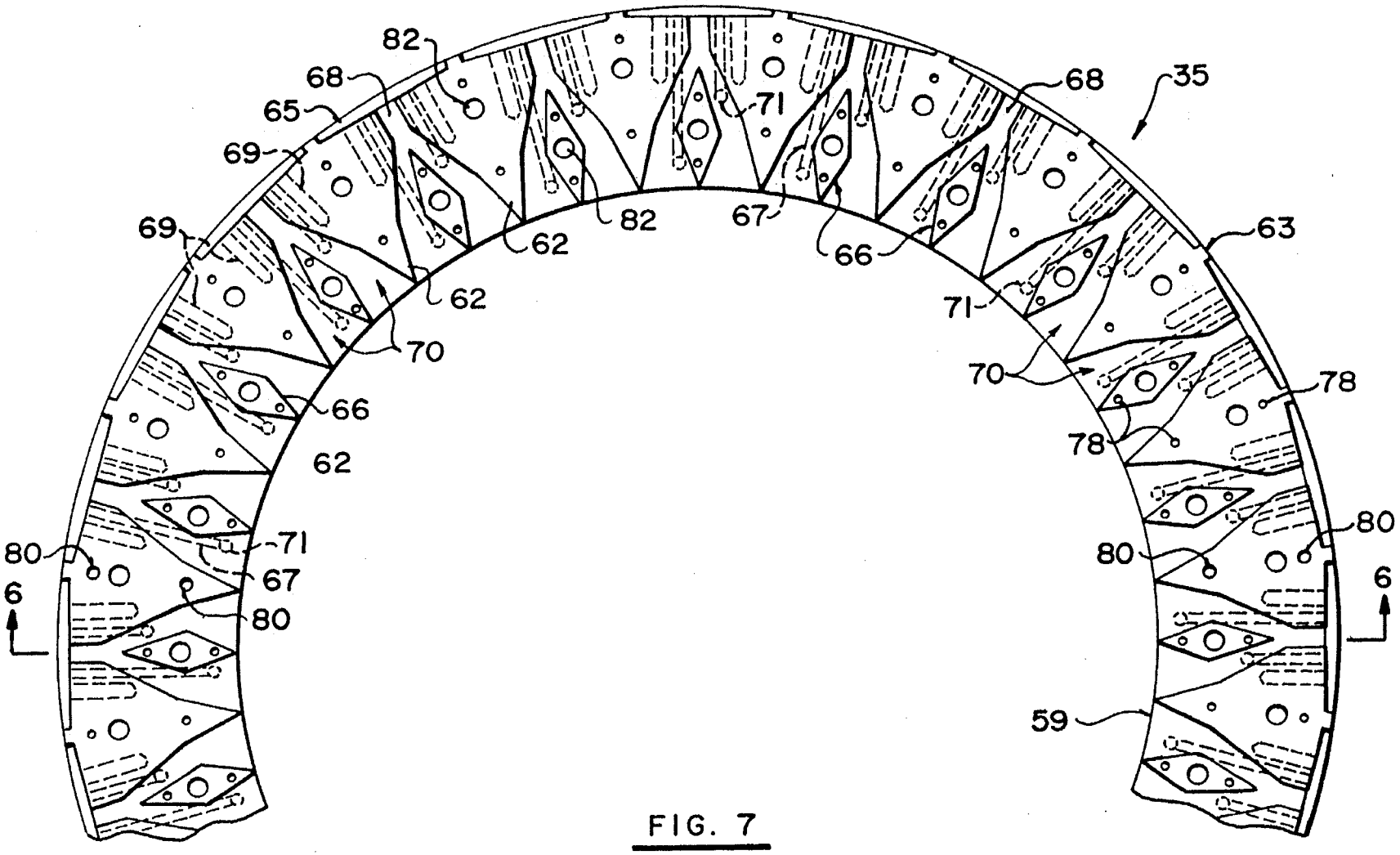
FIG. 7 is a partial top view of the hopper ring assembly shown in FIG. 6 with internal details shown in dotted outline.
Figure 8:
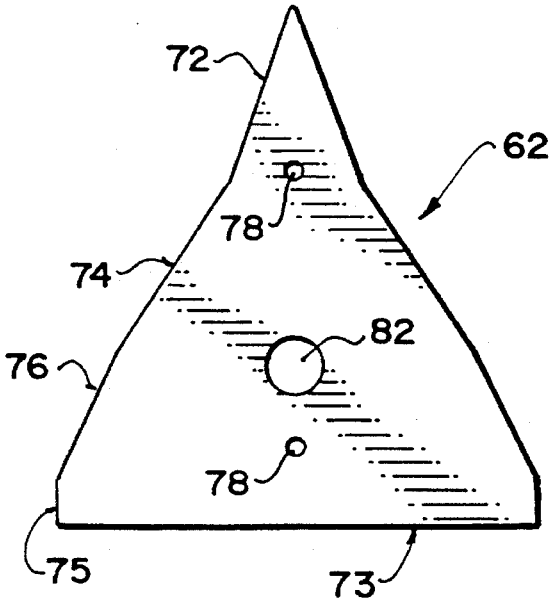
FIG. 8 is a plan view of a hopper half.
Figure 9:
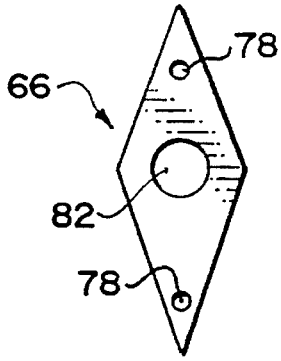
FIG. 9 is a plan view of a hopper insert.

As shown in FIG. 7, hoppers 70 are formed between rings 60 and 64 by placement of hopper halves 62. The shape of the walls of hoppers 70 is important in that it is desirable to have mass flow in the hoppers when the flow control valves are opened and to avoid funnel flow or blockage. Mass flow occurs when all particles in the hopper move each time the hopper outlet is opened. It is a well known exercise to calculate the critical angle of the hopper wall to the vertical at any given point to achieve mass flow when the force acting on the particles is gravity and hence where the force vectors have virtually constant magnitude and direction. See for example "Storage and Flow of Solids", Andrew W. Jenike, Bull of the U. of Utah, no. 123, November 1983. Here it is important to note that both the magnitude and direction of the force vectors vary depending on the position of a particle in the hopper. In the preferred embodiment, it was found that mass flow was achieved by forming three surfaces 72, 74 and 76 in the wall of the hopper half 62, shown in FIG. 8. Where surface 75 is perpendicular to wall 73, surface 76 forms an angle of 26 degrees with surface 75, surface 74 forms an angle of 34 degrees with surface 75, and surface 72 forms an angle of 20 degrees with surface 75. Hopper insert 66 shown in FIG. 9 serves to prevent funnel flow in the hopper 70. Holes 78 in halves 62 and inserts 66 are aligned with corresponding holes drilled partially through lower ring 64 by means of metal dowels. Two of these dowel holes 80 and corresponding dowels are made larger in diameter than the remaining holes 78 and extend completely through the two rings for purposes of indexing and alignment. Holes 82 are used to bolt rings 60 and 64 together and secure them to lower bowl section 30 and lip section 31 through corresponding holes 82 in rings 60, 64 and flanges 45 and 47.

Flow control valves 37, shown in detail in FIG. 12 through 19, are air controlled mini pinch valves constructed with sleeves of the type manufactured by Linatex Inc. Each valve unit 37 consists of a set of two valves—an inboard valve 101 and an outboard valve 103 separated by a spacer 105, and provided with an end cap 107. The valve bodies are moulded and machined from polyurethane plastic. Each valve has a central bore 100 which communicates with the hopper outlets 68 and in which is positioned a flexible cylindrical sleeve 102 of abrasion resistant material sold under the trade mark LINATEX™. The ends of sleeves 102 have annular flanges 117 which are held in corresponding depressions 109 in the valve bodies. Air passageways 110 communicate with passageways 67 in the hopper assembly, with one passageway 110 extending to chamber 112 in inboard valve body 101 and one extending through to chamber 114 in outboard valve body 103. (Chambers 112 and 114 are formed by drilling a hole from the exterior of the body and plugging the outer entrance of the hole.) So long as the air pressure in chambers 112 or 114 which is applied to the exterior surface of the sleeve 102 in the valve through passageways 110 is sufficiently greater than the pressure within the bore 100 of the valve, the sleeve 102 is compressed and closes off the central bore 100, preventing the passage of concentrate. When air pressure to the valve in passageway 110 is reduced the sleeve 102 opens and material may flow through the valve.

End plate 107 is secured to the valve bodies and hopper ring assembly through holes using bolts or the like. End plate 107 has a wear nozzle 108 of wear resistant material inserted around bore 100 to reduce wear from the flow of concentrate. O-rings are provided in annular depressions 122 to seal the passageway 110. This construction allows the entire hopper ring assembly and flow control valves to be removed from the machine as a single unit. By varying the thickness of spacers 105, the space between the valves can be adjusted for different materials.

As indicated above, an electrical control is provided which sets the length of time the two sets of slurry control valves remain closed and the length of time they remain open. It controls variable speed four-way solenoid valve 56 which causes the compressed air supply to be alternately connected to or disconnected from the respective lines 40 and pressure in the lines to be released to the atmosphere. The solenoid valve thus operates so that when the inboard valves are shut, the outboard valves are opened, and vice versa. This permits a controlled flow of concentrate to be released from the hoppers. The exhaust ports on the solenoid can be independently throttled to permit fine-tuning of the valve operation.

In operation, air pressure is typically first applied to the inboard flow control valves 101 to close them. Motor 9 is activated to rotate the rotor. The slurry-feed is introduced to the spinning rotor through feed pipe 18. Centrifugal forces cause the slurry to climb up the inner surface of the rotor bowl past slot 55 before being expelled past lip 31, into tailings launder 14 and thence out of the machine through discharge port 19. Whereas in the inventor's ,batch centrifuge the concentrate accumulates along the wall surface of the retention zone, to be subsequently washed out, in this continuous discharge centrifuge the heavier concentrate particles accumulate in the hoppers 70.

Hoppers 70 are initially empty prior to introduction of the slurry. They rapidly fill with solids as the slurry is introduced. The hopper outlets remain closed during the initial stage. As the process advances, heavier concentrate accumulates in the retention zone of the concentrator in the same way as concentrate accumulates in the inventor's batch centrifuge. In this continuous discharge concentrator, this accumulation of concentrate fills the hoppers. The timed opening of the flow control valves now operates to periodically remove some of the material from the hopper. Such material is expelled by centrifugal force through valve bore 100 into concentrate launder 16.

Thus when the hopper outlet 68 is first opened by the opening of valve 101, the layer of concentrate which has formed on the "top" or inner level of the hopper moves "downwardly" (outwardly) in the hopper into bore 100 of valve 101, but no further since valve 103 is closed. Valve 103 is then opened, while valve 101 closes, allowing the portion of material to be expelled from bore 100. The hopper outlet 68 is now closed and a new layer of concentrate begins to form on the top level of the hopper 70. This process is periodically repeated so that eventually a series of layers of enriched concentrate is proceeding down the hopper to be expelled into the concentrate launder. The timing of the flow control valves is adjusted to optimize recovery and grade of the concentrate.

A modification of the foregoing embodiment may be made to adapt the machine for separation of the higher specific gravity particulate material where the amount of recovered concentrate is high, and for use in dewatering of particulate materials. In such situations the valve structure described above becomes too slow to provide an adequate flow of concentrate from the hopper. In this further embodiment, the wear nozle 108 or one of the valves, preferably the outboard valve 103, is replaced with a nozzle 200 shown in FIG. 20 and 21 which remains open throughout the process. The valve 103 initially remains closed, while the material in the hopper is in a fluid or slurry state in which solid particles are suspended in the liquid. As the rotor is rotated and slurry feed continues, the pulp density in the hopper increases. When the pulp density has reached an adequate density, valve is opened, and there is a constant outflow of material through the outlet nozzle 200. The rate of flow through each nozzle is determined by the nature of the slurry, the size and shape of the nozzle and speed of rotation of the rotor. Optimum nozzle size and shape therefore will vary according to the particular application. The flow rate is also a function of the number of nozzles. For example, in treating 30 tons per hour of slurry, 24 nozzles each having a minimum diameter of approximately ⅛" has been found to be useful at a rotational speed of 600 rpm with a 20" diameter rotor. The concentrate obtained contained 25% of the gold that was in the original feed, in 3% of the total dry weight of the feed, with a solids content of 88% by weight. In effect the nozzle acts as a gross adjustment with small adjustments to output being achieved by adjusting the rotor speed and/or input feed rate to maintain optimum performance. In some applications it may be possible to achieve the desired flow characteristics without using a valve.

As will be apparent to those skilled in the art, various modifications and adaptations of the structure above described may be made without departing from the spirit of the invention, the scope of which is to be construed in accordance with the accompanying claims. While the preferred embodiment has been described in the context of the separation of higher density particles from a slurry, it will be apparent to those skilled in the art that the invention has similar application in the separation of any two flowable substances of differing density, whether solid particles from solid particles, liquid from liquid or solid particles from liquid. Further, while preferred embodiments have been described using valves and nozzles as flow control devices, in some situations the invention may be operated using other controls such as augers at the hopper outlet for flow control.

I claim:

1. A concentrator for separating particulate material of higher specific gravity from particulate material of lower specific gravity, comprising:

(a) a hollow drum (23) having an open end and an inner surface;

(b) means (25) for rotatably supporting said drum on an axis;

(c) drive means (9, 27) for rotating said drum about said axis; and (d) material supply means (18) to deliver said particulate material into tie end of said drum spaced from said open end;

wherein said interior surface of said hollow drum (23) comprises an outwardly inclined migration zone (C), a retention zone (B) above said migration zone which is substantially parallel to said axis of rotation and an inwardly inclined lip zone (A) above said retention zone (B), where said hollow drum comprises an open interior providing unobstructed delivery of said particulate material to said migration zone (C) of said interior surface and where the respective lengths of said migration, retention and lip zones and the relative degrees of inclination of said migration and lip zones are selected to provide a sufficient component of force on said particulate, material to expel said lighter particulate material from said drum and to permit said heavier particulate material to be retained in said retention zone; characterized in that said concentrator further comprises:

e) a plurality of cavities (70) extending outwardly of said retention zone (B) with respect to the axis of rotation of said hollow drum, said cavities. (70) each having an inlet (55) and an outlet (68) located outwardly from said inlet, the inlets (55) of said cavities communicating with said retention zone (B), and wherein each said cavity is a hopper comprising walls having slope angles sufficiently steep to provide mass flow; and f) flow controlling means (37) for controlling the flow of material from said outlets (68) of said cavities (70), said flow controlling means being adapted for alternately retaining or releasing said material.

2. The centrifugal concentrator of claim 1 wherein a flow-obstructing element (66) is provided in each said cavity at a location spaced radially inwardly from said outlet (68) of each said cavity (70).

3. The centrifugal concentrator of claim 1 wherein each vertical wall of each said cavity (70) comprises three adjacent wall sections (76, 74, 72) extending from said outlet (68) to said inlet (55), said first wall section (76) forming an angle of approximately 26 degrees with a radius of said hollow drum (23), said second wall section (74) forming an angle of approximately 34 degrees with a radius of said hollow drum (23), and said third wall section (72) forming an angle of approximately 20 degrees with a radius of said hollow drum (23).

4. The centrifugal concentrator of claim 1 further comprising:

g) control means for controlling the timing of said alternate retaining and releasing.

5. The centrifugal concentrator of claim 1 wherein said flow controlling means (37) comprises valve means (101).

6. The centrifugal concentrator of claim 5 wherein said valve means each comprises two valves (101, 103) in series.

7. The centrifugal concentrator of claim 6 wherein said valve means (101, 103) operate periodically.

8. The centrifugal concentrator of claim 5 wherein said valve means (101) are pneumatically operated.

9. The centrifugal concentrator of claim 1 wherein said flow controlling means comprises in series valve means (101) and nozzle means (200) wherein said valve means (101) is inboard of said nozzle means (200).

10. The centrifugal concentrator of claim 1 wherein said flow controlling means (37) comprise pneumatically operated pinch valves (101).

11. The concentrator of claim 1 wherein said cavities (70) are formed between separate annular rings (60, 64) secured to said drum.

12. A method of operating a concentrator for separating particulate material of high or specific gravity from particulate material of lower specific gravity, said concentrator comprising:

(a) a hollow drum (23) having an open end and an inner surface;

(b) means (25) for rotatably supporting said drum on an axis;

(c) drive means (9, 27) for rotating said drum about said axis; and (d) material supply means (18) to deliver said particulate material into the end of said drum spaced from said open end;

wherein said interior surface of said drum comprises an outwardly inclined migration zone (C), a retention zone (B) above said migration zone which is substantially parallel to said axis of rotation and an inwardly inclined lip zone (C) above said retention zone (B), where said hollow drum comprises an open interior providing unobstructed delivery of said particulate material to said migration zone (C) of said interior surface and where the respective lengths of said migration, retention and lip zones and the relative degrees of inclination of said migration and lip zones are selected to provide a sufficient component of force on said particulate material to expel said lighter particulate material from said drum and to permit said heavier particulate material to be retained in said retention zone; e) a plurality of cavities (70) extending outwardly of said retention zone (B) with respect to the axis of rotation of said hollow drum, said cavities (70) each having an inlet (55) and an outlet (68) located outwardly from said inlet, the inlets (55) of said cavities communicating with said retention zone (B), and wherein the walls of said cavities (70) are configured to provide far mass flow; and f) flow controlling means (37) for controlling the flow of material from said outlets (68) of said cavities (70), said flow controlling means being adapted for alternately retaining or releasing said material;

comprising the steps of:

i) rotating said hollow drum (23) initially with said flow controlling means (37) closed to retain material in said cavities (70);

ii) introducing said material to the interior of said hollow drum (23); and iii) opening said flow controlling means (37) to release said material from said cavities (70) when said material in said cavities (70) has the characteristics required to permit the desired flow of material from the outlets of said cavities (70).

13. The method of claim 12 further comprising the steps of:

iv) monitoring the flow of material from said cavities (70); and v) adjusting the speed of rotation of said hollow drum (23) or the rate of supply of said slurry or both to obtain the desired ongoing flow of material from the outlets of said cavities (70).

* * * * *